US005214706A

United States Patent [19]

Minde

[11] Patent Number: 5,214,706

[45] Date of Patent: May 25, 1993

[54] METHOD OF CODING A SAMPLED SPEECH SIGNAL VECTOR

[75] Inventor: Tor B. Minde, Luleå, Sweden

[73] Assignee: Telefonaktiebolaget LM Ericsson, Stockholm, Sweden

[21] Appl. No.: 738,552

[22] Filed: Jul. 31, 1991

[30] Foreign Application Priority Data

Aug. 10, 1990 [SE] Sweden ..... 90026220

[51] Int. Cl.[5] ..... G01L 5/00

[52] U.S. Cl. ..... 381/36; 381/40; 395/2

[58] Field of Search ..... 381/36, 40; 395/2

[56] References Cited

U.S. PATENT DOCUMENTS

| | | | |
|---|---|---|---|
| 4,727,354 | 2/1988 | Lindsay | 340/347 |
| 4,817,157 | 3/1989 | Gerson | 381/40 |
| 4,860,355 | 8/1989 | Copperi | 381/36 |
| 4,899,385 | 2/1990 | Ketchum et al. | 381/36 |

FOREIGN PATENT DOCUMENTS 0361443 4/1990 European Pat. Off. .

*Primary Examiner*—Emanuel S. Kemeny

*Attorney, Agent, or Firm*—Burns, Doane, Swecker & Mathis

[57] ABSTRACT

The invention relates to a method of coding a sampled speech signal vector by selecting an optimal excitation vector in an adaptive code book. This optimal excitation vector is obtained by maximizing the energy normalized square of the cross correlation between the convolution of the excitation vectors with the impulse response of a linear filter and the speech signal vector. Before the convolution the vectors of the code book are block normalized with respect to the vector component largest in magnitude. In a similar way the speech signal vector is block normalized with respect to its component largest in magnitude. Calculated values for the squared cross correlation $C_I$ and the energy $E_I$ and stored corresponding values $C_M$, $E_M$ for the best excitation vector so far are divided into a mantissa and a scaling factor with a limited number of scaling levels. The number of levels can be different for squared cross correlation and energy. During the calculation of the products $C_I \cdot E_M$ and $E_I \cdot C_M$, which are used for determining the optimal excitation vector, the respective mantissas are multiplied and a separate scaling factor calculation is performed.

14 Claims, 2 Drawing Sheets

METHOD OF CODING A SAMPLED SPEECH SIGNAL VECTOR

TECHNICAL FIELD

The present invention relates to a method of coding a sampled speech signal vector by selecting an optimal excitation vector in an adaptive code book.

PRIOR ART

In e.g. radio transmission of digitized speech it is desirable to reduce the amount of information that is to be transferred per unit of time without significant reduction of the quality of the speech.

A method known from the article "Code-excited linear prediction (CELP): High-quality speech at very low bit rates", IEEE ICASSP-85, 1985 by M. Schroeder and B. Atal to perform such an information reduction is to use speech coders of so called CELP-type in the transmitter. Such a coder comprises a synthesizer section and an analyzer section. The coder has three main components in the synthesizer section, namely an LPC-filter (Linear Predictive Coding filter) and a fixed and an adaptive code book comprising excitation vectors that excite the filter for synthetic production of a signal that as close as possible approximates the sampled speech signal vector for a frame that is to be transmitted. Instead of transferring the speech signal vector itself the indexes for excitation vectors in code books are then among other parameters transferred over the radio connection. The reciver comprises a corresponding synthesizer section that reproduces the chosen approximation of the speech signal vector in the same way as on the transmitter side.

To choose between the best possible excitation vectors from the code books the transmitter portion comprises an analyzer section, in which the code books are searched. The search for optimal index in the adaptive code book is often performed by a exhaustive search through all indexes in the code book. For each index in the adaptive code book the corresponding excitation vector is filtered through the LPC-filter, the output signal of which is compared to the sampled speech signal vector that is to be coded.

An error vector is calculated and filtered through the weighting filter. Thereafter the components in the weighted error vector are squared and summed for forming the quadratic weighted error. The index that gives the lowest quadratic weighted error is then chosen as the optimal index. An equivalent method known from the article "Efficient procedures for finding the optimum innovation in stochastic coders", IEEE ICASSP-86, 1986 by I. M. Trancoso and B. S. Atal to find the optimal index is based on maximizing the energy normalized squared cross correlation between the synthetic speech vector and the sampled speech signal vector.

These two exhaustive search methods are very costly as regards the number of necessary instruction cycles in a digital signal processor, but they are also fundamental as regards retaining a high quality of speech.

Searching in an adaptive code book is known per se from the American patent specification 3 899 385 and the article "Design, implementation and evaluation of a 8.0 kbps CELP coder on a single AT&T DSP32C digital signal processor", IEEE Workshop on speech coding for telecommunications, Vancouver, Sep. 5–8, 1989, by K. Swaminathan and R. V. Cox.

A problem in connection with an integer implementation is that the adaptive code book has a feed back (long term memory). The code book is updated with the total excitation vector (a linear combination of optimal excitation vectors from the fixed and adaptive code books) of the previous frame. This adaption of the adaptive code book makes it possible to follow the dynamic variations in the speech signal, which is essential to obtain a high quality of speech. However, the speech signal varies over a large dynamic region, which means that it is difficult to represent the signal with maintained quality in single precision in a digital signal processor that works with integer representation, since these processors generally have a word length of 16 bits, which is insufficient. The signal then has to be represented either in double precision (two words) or in floating point representation implemented in software in an integer digital signal processor. Both these methods are, however, costly as regards complexity.

SUMMARY OF THE INVENTION

An object of the present invention is to provide a method for obtaining a large dynamical speech signal range in connection with analysis of an adaptive code book in an integer digital signal processor, but without the drawbacks of the previously known methods as regards complexity.

This object is accomplished in a method for coding a sampled speech signal vector by selecting an optimal excitation vector in an adaptive code book, said method including (a) successively reading predetermined excitation vectors from said adaptive code book, (b) convolving each read excitation vector with the impulse response of a linear filter, (c) forming for each filter output signal:

(c1) on the one hand a measure $C_I$ of the square of the cross correlation with the sampled speech signal vector;

(c2) on the other hand a measure $E_I$ of the energy of the filter output signal, (d) multiplying each measure $C_I$ by a stored measure $E_M$ corresponding to the measure $E_I$ of that excitation vector that hitherto has given the largest value of the ratio between the measure $C_I$ of the square of the cross correlation between the filter output signal and the sampled speech signal vector and the measure $E_I$ of the energy of the filter output signal, (e) multiplying each measure $E_I$ by a stored measure $C_M$ corresponding to the measure $C_I$ of that excitation vector that hitherto has given the largest value of the ratio between the measure $C_I$ of the square of the cross correlation between the filter output signal and the sampled speech signal vector and the measure $E_I$ of the energy of the filter output signal, (f) comparing the products in steps (d) and (e) to each other and substituting the stored measures $C_M$, $E_M$ by the measures $C_I$ and $E_I$, respectively, if the product in step (d) is larger than the product in step (e), and (g) choosing that excitation vector that corresponds to the largest value of the ratio between the first measure $C_I$ of the square of the cross correlation between the filter output signal and the sampled speech signal vector and the second measure $E_I$ of the energy of the filter output signal as the optimal excitation vector in the adaptive code book, wherein said method further comprises (A) block normalizing said predetermined excitation vectors of the adaptive code book with respect to the component with the maximum absolute value in a set of excitation vectors from the adaptive code book before the convolution in step (b), (B) block normalizing the sampled speech signal vector with respect to that of its components that has the maximum absolute value before forming the measure $C_I$ in step (c1), (C) dividing the measure $C_I$ from step (c1) and the stored measure $C_M$ into a respective mantissa and a respective first scaling factor with a predetermined first maximum number of levels, (D) dividing the measure $E_I$ from step (c2) and the stored measure $E_M$ into a respective mantissa and a respective second scaling factor with a predetermined second maximum number of levels, and (E) forming said products in step (d) and (e) by multiplying the respective mantissas and performing a separate scaling factor calculation.

SHORT DESCRIPTION OF THE DRAWINGS

The invention, further objects and advantages obtained by the invention are best understood with reference to the following description and the accompanying drawings, in which FIG. 1 shows a block diagram of an apparatus in accordance with the prior art for coding a speech signal vector by selecting the optimal excitation vector in an adaptive code book;

PREFERRED EMBODIMENT

In the different Figures the same reference designations are used for corresponding elements.

Figure 1:
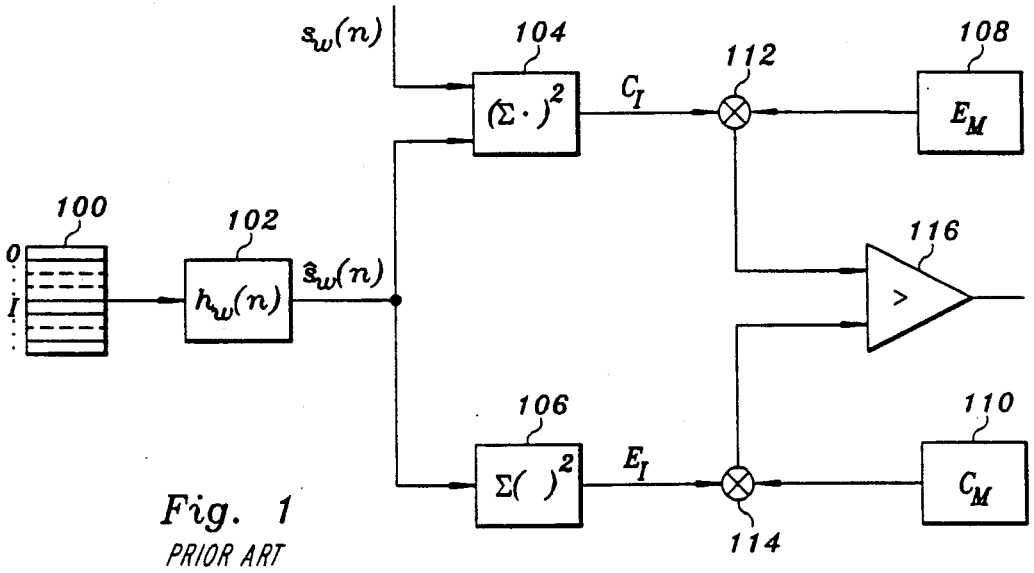
Fig. 1 PRIOR ART

FIG. 1 shows a block diagram of an apparatus in accordance with the prior art for coding a speech signal vector by selecting the optimal excitation vector in an adaptive code book. The sampled speech signal vector $s_w(n)$, e.g. comprising 40 samples, and a synthetic signal $\hat{s}_w(n)$, that has been obtained by convolution of an excitation vector from an adaptive code book 100 with the impulse response $h_w(n)$ of a linear filter in a convolution unit 102, are correlated with each other in a correlator 104. The output signal of correlator 104 forms an measure $C_I$ of the square of the cross correlation between the signals $S_w(n)$ and $\hat{s}_w(n)$. A measure of the cross correlation can be calculated e.g. by summing the products of the corresponding components in the input signals $s_w(n)$ and $\hat{s}_w(n)$. Furthermore, in an energy calculator 106 a measure $E_I$ of the energy of the synthetic signal $\hat{s}_w(n)$ is calculated, e.g. by summing the squares of the components of the signal. These calculations are performed for each of the excitation vectors of the adaptive code book.

For each calculated pair $C_I$, $E_I$ the products $C_I \cdot E_M$ and $E_I \cdot C_M$ are formed, where $C_M$ and $E_M$ are the values of the squared cross correlation and energy, respectively, for that excitation vector that hitherto has given the largest ratio $C_I/E_I$. The values $C_M$ and $E_M$ are stored in memories 108 and 110, respectively, and the products are formed in multipliers 112 and 114, respectively. Thereafter the products are compared in a comparator 116. If the product $C_I \cdot E_M$ is greater than the product $E_I \cdot C_M$, then $C_M$, $E_M$ are updated with $C_I$, $E_I$, otherwise the old values of $C_M$, $E_M$ are maintained. Simultaneously with the updating of $C_M$ and $E_M$ a memory, which is not shown, storing the index of the corresponding vector in the adaptive code book 100 is also updated. When all the excitation vectors in the adaptive code book 100 have been examined in this way the optimal excitation vector is obtained as that vector that corresponds to the values $C_M$, $E_M$, that are stored in memories 108 and 110, respectively. The index of this vector in code book 100, which index is stored in said memory that is not shown in the drawing, forms an essential part of the code of the sampled speech signal vector.

Figure 2:
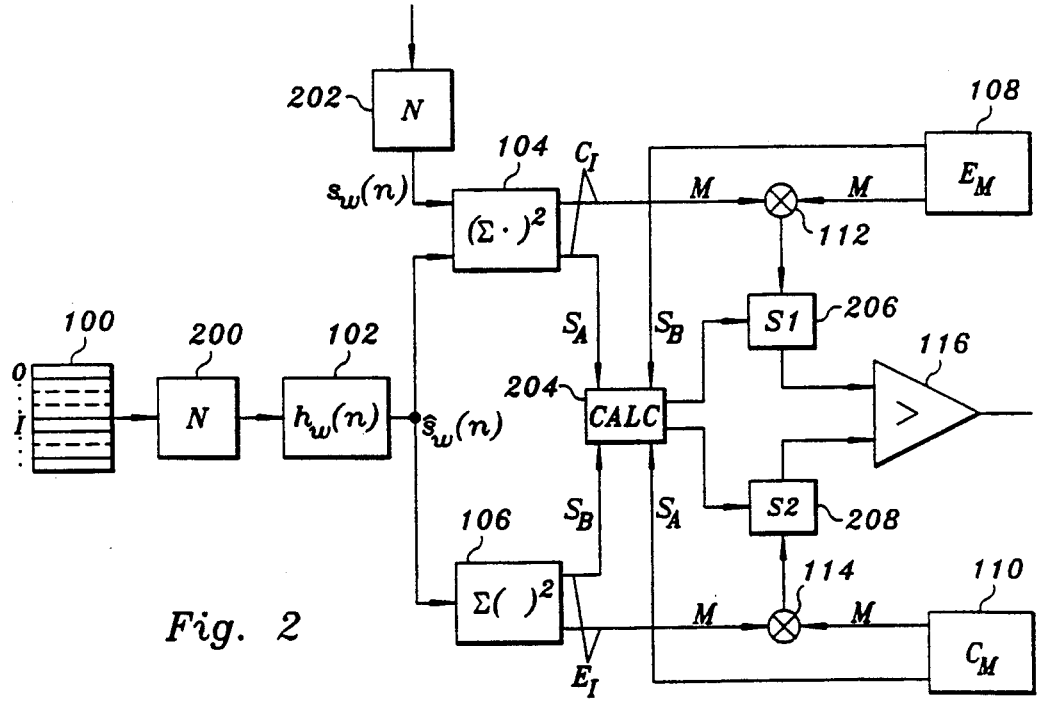
FIG. 2 shows a block diagram of a first embodiment of an apparatus for performing the method in accordance with the present invention.

FIG. 2 shows a block diagram of a first embodiment of an apparatus for performing the method in accordance with the present invention. The same parameters as in the previously known apparatus in accordance with FIG. 1, namely the squared cross correlation and energy, are calculated also in the apparatus according to FIG. 2. However, before the convolution in convolution unit 102 the excitation vectors of the adaptive code book 100 are block normalized in a block normalizing unit 200 with respect to that component of all the excitation vectors in the code book that has the largest absolute value. This is done by searching all the vector components in the code book to determine that component that has the maximum absolute value. Thereafter this component is shifted to the left as far as possible with the chosen word length. In this specification a word length of 16 bits is assumed. However, it is appreciated that the invention is not restricted to this word length but that other word lengths are possible. Finally the remaining vector components are shifted to the left the same number of shifting steps. In a corresponding way the speech signal vector is block normalized in a block normalizing unit 202 with respect to that of its components that has the maximum absolute value.

After the block normalizations the calculations of the squared cross correlation and energy are performed in correlator 104 and energy calculator 106, respectively. The results are stored in double precision, i.e. in 32 bits if the word length is 16 bits. During the cross correlation and energy calculations a summation of products is performed. Since the summation of these products normally requires more than 32 bits an accumulator with a length of more than 32 bits can be used for the summation, whereafter the result is shifted to the right to be stored within 32 bits. In connection with a 32 bits accumulator an alternative way is to shift each product to the right e.g. 6 bits before the summation. These shifts are of no practical significance and will therefore not be considered in the description below.

The obtained results are divided into a mantissa of 16 bits and a scaling factor. The scaling factors preferably have a limited number of scaling levels. It has proven that a suitable maximum number of scaling levels for the cross correlation is 9, while a suitable maximum number of scaling levels for the energy is 7. However, these values are not critical. Values around 8 have, however, proven to be suitable. The scaling factors are preferably stored as exponents, it being understood that a scaling factor is formed as $2^E$, where E is the exponent. With the above suggested maximum number of scaling levels the scaling factor for the cross correlation can be stored in 4 bits, while the scaling factor for the energy requires 3 bits. Since the scaling factors are expressed as $2^E$ the scaling can be done by simple shifting of the mantissa.

To illustrate the division into mantissa och scaling factor it is assumed that the vector length is 40 samples and that the word length is 16 bits. The absolute value of the largest value of a sample in this case is $2^{16-1}$. The largest value of the cross correlation is:

$$CC_{max}=40.2^{2(16-1)}=(5\cdot 2^{12})\cdot 2^{21}$$

The scaling factor $2^{21}$ for this largest case is considered as 1, i.e. $2^{\circ}$, while the mantissa is $5\cdot 2^{12}$.

It is now assumed that the synthetic output signal vector has all its components equal to half the maximum value, i.e. $2^{16-2}$, while the sampled signal vector still only has maximum components. In this case the cross correlation becomes:

$$CC_I=40\cdot 2^{15}\cdot 2^{14}=(5\cdot 2^{12})\cdot 2^{20}$$

The scaling factor for this case is considered to be $2^1$, i.e. 2. while the mantissa still is $5.2^{12}$. Thus, the scaling factor indicates how many times smaller the result is than $CC_{max}$.

With other values for the vector components the cross correlation is calculated, whereafter the result is shifted to the left as long as it is less then $CC_{max}$. The number of shifts gives the exponent of the scaling factor, while the 15 most significant bits in the absolute value of the result give the absolute value of the mantissa.

Since the number of scaling factor levels can be limited the number of shifts that are performed can also be limited. Thus, when the cross correlation is small it may happen that the most significant bits of the mantissa comprise only zeros even after a maximum number of shifts.

$C_I$ is then calculated by squaring the mantissa of the cross correlation and shifting the result 1 bit to the left, doubling the exponent of the scaling factor and incrementing the resulting exponent by 1.

$E_I$ is divided in the same way. However, in this case the final squaring is not required.

In the same way the stored values $C_M$, $E_M$ for the optimal excitation vector hitherto are divided into a 16 bits mantissa and a scaling factor.

The mantissas for $C_I$ and $E_M$ are multiplied in a multiplier 112, while the mantissas for $E_I$ and $C_M$ are multiplied in a multiplier 114. The scaling factors for these parameters are transferred to a scaling factor calculation unit 204, that calculates respective scaling factors S1 and S2 by adding the exponents of the scaling factors for the pair $C_I$, $E_M$ and $E_I$, $C_M$, respectively. In scaling units 206, 208 the scaling factors S1, S2 are then applied to the products from multipliers 112 and 114, respectively, for forming the scaled quantities that are to be compared in comparator 116. The respective scaling factor is applied by shifting the corresponding product to the right the number of steps that is indicated by the exponent of the scaling factor. Since the scaling factors can be limited to a maximum number of scaling levels it is possible to limit the number of shifts to a minimum that still produces good quality of speech. The above chosen values 9 and 7 for the cross correlation and energy, respectively, have proven to be optimal as regards minimizing the number of shifts and retaining good quality of speech.

A drawback of the implementation of FIG. 2 is that shifts may be necessary for both input signals. This leads to a loss of accuracy in both input signals, which in turn implies that the subsequent comparison becomes more uncertain. Another drawback is that a shifting of both input signals requires unnecessary long time.

Figure 3:
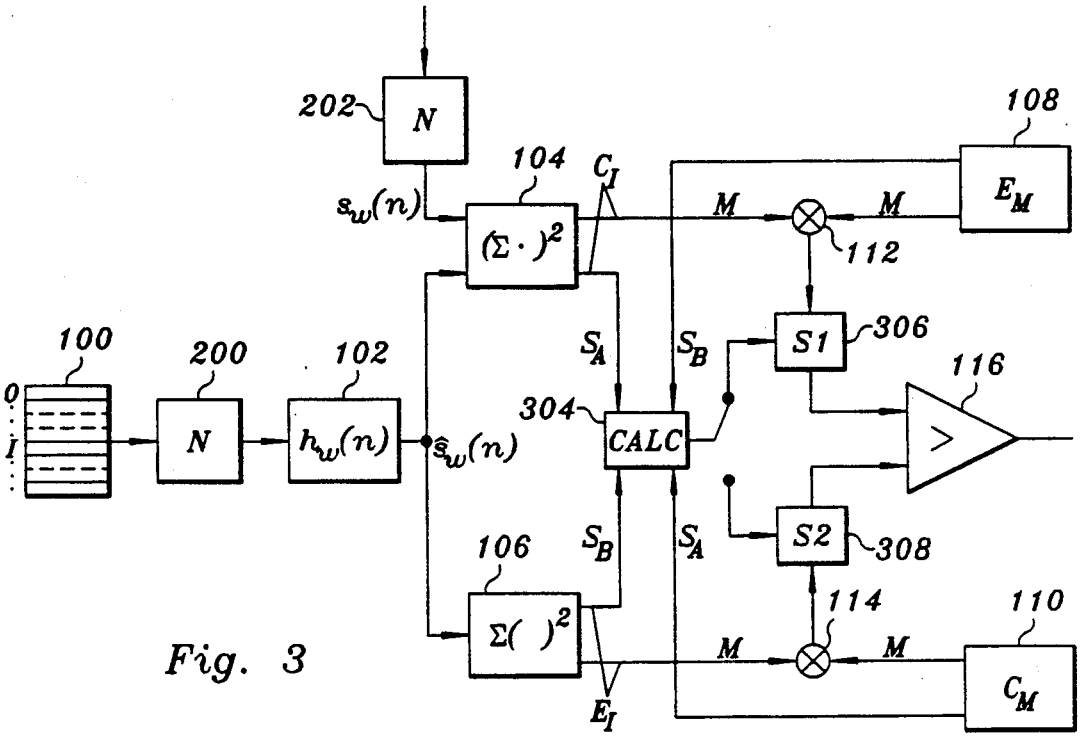
FIG. 3 shows a block diagram of a second, preferred embodiment of an apparatus for performing the method in accordance with the present invention.

FIG. 3 shows a block diagram of a second, preferred embodiment of an apparatus for performing the method in accordance with the present invention, in which the above drawbacks have been eliminated. Instead of calculating two scaling factors the scaling factor calculation unit 304 calculates an effective scaling factor. This is calculated by subtracting the exponent for the scaling factor of the pair $E_I$, $C_M$ from the exponent of the scaling factor for the pair $C_I$, $E_M$. If the resulting exponent is positive the product from multiplier 112 is shifted to the right the number of steps indicated by the calculated exponent. Otherwise the product from multiplier 114 is shifted to the right the number of steps indicated by the absolute value of the calculated exponent. The advantage with this implementation is that only one effective shifting is required. This implies fewer shifting steps, which in turn implies increased speed. Furthermore the certainty in the comparison is improved since only one of the signals has to be shifted.

An implementation of the preferred embodiment in accordance with FIG. 3 is illustrated in detail by the PASCAL-program that is attached before the patent claims.

Figure 4:
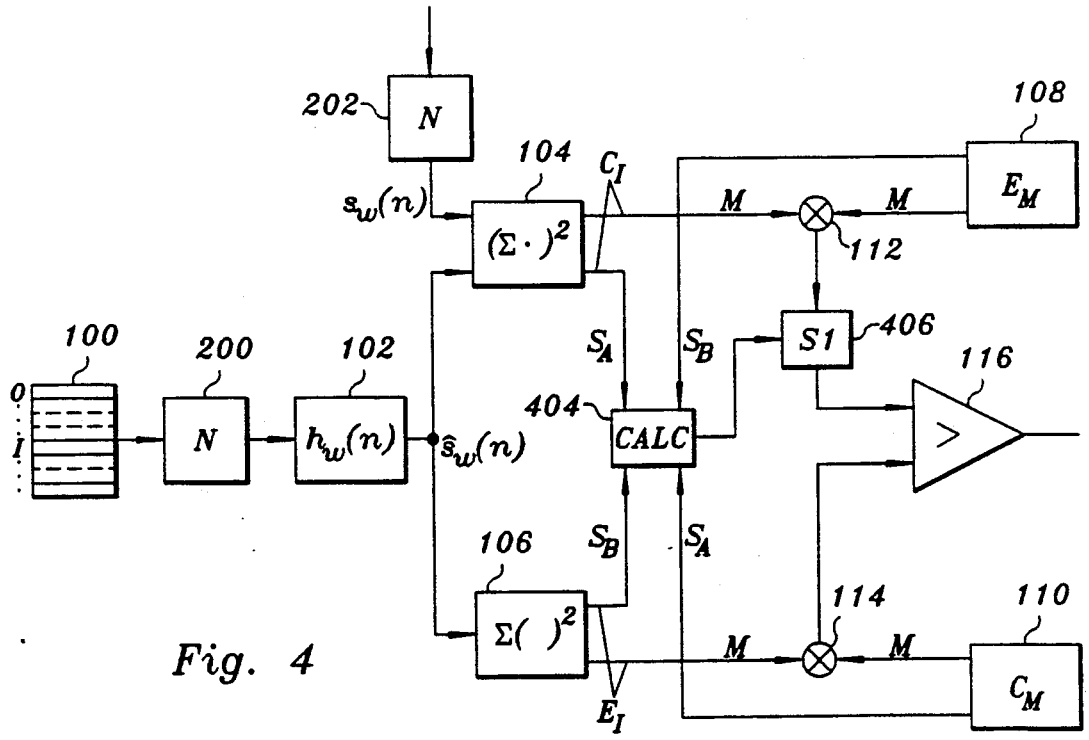
FIG. 4 shows a block diagram of a third embodiment of an apparatus for performing the method in accordance with the present invention.

FIG. 4 shows a block diagram of a third embodiment of an apparatus for performing the method in accordance with the present invention. As in the embodiment of FIG. 3 the scaling factor calculation unit 404 calculates an effective scaling factor, but in this embodiment the effective scaling factor is always applied only to one of the products from multipliers 112, 114. In FIG. 4 the effective scaling factor is applied to the product from multiplier 112 over scaling unit 406. In this embodiment the shifting can therefore be both to the right and to the left, depending on whether the exponent of the effective scaling factor is positive or negative. Thus, the input signals to comparator 116 require more than one word.

Below is a comparison of the complexity expressed in MIPS (million instructions per second) for the coding method illustrated in FIG. 1. Only the complexity for the calculation of cross correlation, energy and the comparison have been estimated, since the main part of the complexity arises in these sections. The following methods have been compared:

1. Floating point implementation in hardware.
2. Floating point implementation in software on an integer digital signal processor.
3. Implementation in double precision on an integer digital signal processor.
4. The method in accordance with the present invention implemented on an integer digital signal processor.

In the calculations below it is assumed that each sampled speech vector comprises 40 samples (40 components), that each speech vector extends over a time frame of 5 ms, and that the adaptive code book contains 128 excitation vectors, each with 40 components. The estimations of the number of necessary instruction cycles for the different operations on an integer digital signal processor have been looked up in "TMS320C25 USER'S GUIDE" from Texas Instruments.

1. Floating point implementation in hardware.

Floating point operations (FLOP) are complex but implemented in hardware. For this reason they are here counted as one instruction each to facilitate the comparison.

| | |
|---|---|
| Cross correlation: | 40 multiplications-additions |
| Energy: | 40 multiplications-additions |
| Comparision: | 4 multiplication |
| | 1 subtractions |
| Total | 85 operations |
| This gives 128 · 85/0.005 = 2.2 MIPS | |

2. Floating point implementation i software.

The operations are built up by simpler insertions. The required number of instructions is approximately:

| | |
|---|---|
| Floating point multiplication: | 10 instructions |
| Floating point addition: | 20 instructions |
| This gives: | |
| Cross correlation: | 40 · 10 instructions |
| | 40 · 20 instructions |
| Energy: | 40 · 10 instructions |
| | 40 · 20 instructions |
| Comparision: | 4 · 10 instructions |
| | 1 · 20 instructions |
| Total | 2460 instructions |
| This gives 128 · 2460/0.005 = 63 MIPS | |

3. Implementation in double precision.

The operations are built up by simpler instructions. The required number of instructions is approximately:

| | |
|---|---|
| Multipl.-addition in single precision: | 1 instruction |
| Multiplication in double precision: | 50 instructions |
| 2 substractions in double precision: | 10 instructions |
| 2 normalizations in double precision: | 30 instructions |
| This gives: | |
| Cross correlation: | 40 · 1 instructions |
| Energy: | 40 · 1 instructions |
| Comparision: | 4 · 50 instructions |
| | 1 · 10 instructions |
| | 2 · 30 instructions |
| Total | 350 instructions |
| This gives 128 · 350/0.005 = 9.0 MIPS | |

4. The method in accordance with the present invention.

The operations are built up by simpler instructions. The required number of instructions is approximately:

| | |
|---|---|
| Multipl.-addition in single precision: | 1 instruction |
| Normalization in double precision: | 8 instructions |
| Multiplication in single precision: | 3 instructions |
| Subtraction in single precision: | 3 instructions |
| This gives: | |
| Cross correlation: | 40 · 1 instructions |
| | 9 instructions (number of scaling levels) |
| Energy: | 40 · 1 instructions |
| | 7 instructions (number of scaling levels) |
| Comparison: | 4 · 3 instructions |
| | 5 + 2 instructions (scaling) |
| | 1 · 3 instructions |
| Total | 118 instructions |
| This gives 128 · 118 / 0.005 = 3.0 MIPS | |

It is appreciated that the estimates above are approximate and indicate the order of magnitude in complexity for the different methods. The estimates show that the method in accordance with the present invention is almost as effective as regards the number of required instructions as a floating point implementation in hardware. However, since the method can be implemented significantly more inexpensive in an integer digital signal processor, a significant cost reduction can be obtained with a retained quality of speech. A comparison with a floating point implementation in software and implementation in double precision on an integer digital signal processor shows that the method in accordance with the present invention leads to a significant reduction in complexity (required number of MIPS) with a retained quality of speech.

The man skilled in the art appreciate that different changes and modifications of the invention are possible without departure from the scope of the invention, which is defined by the attached patent claims. For example, the invention can be used also in connection with so called virtual vectors and for recursive energy calculation. The invention can also be used in connection with selective search methods where not all but only predetermined excitation vectors in the adaptive code book are examined. In this case the block normalization can either be done with respect to the whole adaptive code book or with respect to only the chosen vectors.

```
PROGRAM fixed_point;
{
   This program calculates the optimal pitch prediction for an
   adaptive code book. The optimal pitch prediction is also
   filtered through the weighted synthesis filter.
 Input:
      alphaWeight   weighted direct form filter
                    coefficients
      pWeight       signal after synthesis filter
      iResponse     truncated impulse response
      rLTP          pitch predictor filter state
                    history
 Output:
      capGMax       max pitch prediction power
      capCMax       max correlation
      lagX          code word for optimal lag
      bLOpt         optimal pitch prediction
      bPrimeLOpt    optimal filtered pitch prediction
}
 USES MATHLIB
 {
 MATHLIB is a module that simulates basic instructions of
 Texas Instruments digital signal processor TMSC5X and
 defines extended instructions (macros) in terms of these
 basic instructions. The following instructions are used.
 Basic instructions:
      ILADD     arithmetic addition.
      ILMUL     multiplication with 32 bit result.
      IMUL      truncated multiplication scaled to 16 bit.
      IMULR     rounded multiplication scaled to 16 bit.
      ILSHFT    logic n-bit left shift.
      IRSHFT    logic n-bit right shift.
   Extended instructions:
      INORM     normalization of 32 bit input value giving a
                16 bit result norm with rounding.
      IBNORM    block normalization of input array giving a
                normalization of all array elements accord
                ing to max absolute value in input array.
      ILSSQR    sum of squares of elements in input array
                giving a 32 bit result.
      ISMUL     sum of products of elements in two input
                arrays giving a 16 bit result with rounding.
      ILSMUL    sum of products of elements of two input
                arrays giving a 32 bit result.
 }
 CONST
      capGLNormMax =  7;
      capCLNormMax =  9;
```

-continued

```
        truncLength =          20;
        maxLag =               166;
        nrCoeff =              10;
        subframeLength =       40;
        lagOffset =            39;
    TYPE
    integernormtype =          ARRAY [0 . . . 1] OF Integer;
    integerpowertype =         ARRAY [0 . . . 2, 0 . . . 1]
                               OF Integer;
    integerimpulse-            ARRAY [0 . . . truncLength-1]
    responsetype =             OF Integer;
    integerhistorytype =       ARRAY [-maxLag . . . -1]
                               OF Integer;
    integersubframetype =      ARRAY [0 . . . subframelength-1]
                               OF Integer;
    integerparametertype =     ARRAY [1 . . . nrCoeff]
                               OF Integer;
    integerstatetype =         ARRAY [0 . . . nrCoeff] of Integer
    VAR
        iResponse              integerimpulseresponsetype;
        pWeight                integersubframetype;
        rLTP                   integerhistorytype;
        rLTPNorm               integerhistorytype;
        alphaWeight            integerparametertype;
        capGMax                Integerpowertype;
        capCMax                Integerpowertype;
        lagX                   Integer;
        bLOpt                  integersubframetype;
        bPrimeLOpt             integersubframetype;
        rLTPScale              Integer;
        pWeightScale           Integer;
        capGLMax               Integernormtype;
        capCLMax               Integernormtype;
        lagMax                 Integer;
        capGL                  Integernormtype;
        capCL                  Integernormtype;
        bPrimeL                integersubframetype;
        state                  integerstatetype;
        shift,
        capCLSqr,
        capCLMaxSqr            Integer;
        pitchDelay             Integer;
    PROCEDURE pitchInit(
            ZiResponse         integerimpulseresponsetype;
            ZpWeight           integersubframetype;
            ZrLTP              integerhistorytype;
        VAR ZcapGLMax          Integernormtype;
        VAR ZcapCLMax          Integernormtype;
        VAR ZlagMax            Integer;
        VAR ZbPrimeL           integersubframetype);
  {
    Calculates pitch prediction for a pitch delay = 40. Calculates correlation between the calculated pitch prediction and the weighted subframe. Finally, calculates power of pitch prediction
    Input:
        rLPT        r(n) = long term filter state, n < 0
        iResponse   h(n) = impulse response
        pWeight     p(n) = weighted input minus zero input
                    response of H(z)
    Output:
        bPrimeL     pitch prediction b'L(n) = bL(n) * h(n)
        capGLMax    GL; power of pitch prediction start value
        capCLMax    CL; max correlation start value
        lagMax      pitch delay for max correlation start value
}
VAR
    k          Integer;
    Lresult    Integer;  {32 bit}
BEGIN
FOR k: = 0 TO (subframeLength DIV 2) - 1 DO
    ZbPrimeL[k]: = ISMUL(ZiResponse, 0, k, ZrLTP,
        k-40, -40, 1, 'PI0');
    FOR k: = 0 TO (subframeLength DIV 2) - 2 DO
    BEGIN
        Lresult: = ILSMUL(ZiResponse, k + 1, truncLength-
            1, ZrLTP, -1, k-(truncLength-1), 1, 'PI1');
        Lresult: = ILADD(Lresult, 32768, 'PI2');
        ZbPrimeL[k + (subframeLength DIV 2)]: =
        IRSHFT(Lresult,
        16, 'PI3');
```

-continued

```
    END;
    ZbPrimeL[subframeLength-1]: = 0;
    Lresult: = ILSMUL(ZpWeight, 0, subframeLength-1,
            ZbPrimeL, 0, subframeLength-1, -6, 'PI7');
    ZcapCLMax[1]: = INORM(Lresult, capCLNormMax,
            ZcapCLMax[0], 'PI8');
    Lresult: = ILSSQR(ZbPrimeL, 0, subframeLength-1, -6, 'PI9');
    ZcapGLMax[1]: = INORM(Lresult, capGLNormMax,
            ZcapGLMax[0], 'PI10');
    IF ZcapCLMax[0] < = 0 THEN
    BEGIN
        ZcapCLMax[0]: = 0;
        ZcapCLMax[1]: = capCLNormMax;
        ZlagMax: = lagOffset;
      END
      ELSE
      BEGIN
        ZlagMax: = subframeLength;
      END;
    END;
PROCEDURE normalRecursion(
            pitchDelay     Integer;
            ZiResponse     integerimpulseresponsetype;
        VAR ZbPrimeL       integersubframetype;
            ZrLTP          integerhistorytype);
{
    Performs recursive updating of pitch prediction.
    Input:
        pitchDelay     current pitch predictor lag value
                       (41 . . . maxLag)
        rLTP           r(n) = long term filter state, n < 0
        iResponse      h(n) = impulse response
        bPrimeL        pitch prediction, b'L(n) = bL(n) * h(n)
    Output:
        bPrimeL        updated bPrimeL
}
VAR
k          Integer;
Lresult    Integer; {32 bit}
BEGIN
    FOR k: = subframeLength-1 DOWNTO truncLength DO
        ZbPrimeL[k]: = ZbPrimeL[k-1];
    FOR k: = truncLength-1 DOWNTO 1 DO
    BEGIN
        Lresult: = ILMUL(ZiResponse[k], ZrLTP[-pitchDelay],
        'NR4');
        Lresult: = ILADD(ILSHFT(Lresult, 1, 'NR50'), 32768,
        'NR5');
        ZbPrimeL[k]: =
        IRSHFT(ILADD(ILSHFT(ZbPrimeL[k-1],
        16, 'NR6'), Lresult, 'NR7'), 16, 'NR8');
    END;
    Lresult: = ILMUL(ZiResponse[0], ZrLTP[-pitchDelay],
    'NR9');
    ZbPrimeL[0]: = IRSHFT(ILADD(ILSHFT(Lresult, 1, 'NR100'),
    32768, 'NR10'), 16, 'NR11');
END;
PROCEDURE normalCalculation(
            ZpWeight       integersubframetype;
            ZbPrimeL       integersubframetype;
        VAR ZcapGL         integernormtype;
        VAR ZcapCL         integernormtype);
{
    Performs updating of max correlation and pitch prediction
    power.
    Input:
        pWeight        p(n) = weighted input minus zero input
                       response of H(z)
        bPrimeL        pitch prediction b'L(n) = bL(n) * h(n)
    Output:
        capGL          GL; temporary max pitch prediction
                       power
        capCL          CL; temporary max correlation
}
VAR
        Lresult        Integer; {32 bit}
BEGIN
    Lresult: = ILSMUL(ZpWeight, 0, subframeLength-1,
        ZbPrimeL, 0, subframeLength-1, -6, 'NC1');
    ZcapCL[1]: = INORM(Lresult, capCLNormMax, ZcapCL[0],
```

-continued

```
        'NC2');
    Lresult: = ILSSQR(ZbPrimeL, 0, subframeLength-1, -6,
        'NC3');
    ZcapGL[1]: = INORM(Lresult, capGLNormMax, ZcapGL[0],
        'NC5');
END;
PROCEDURE normalComparison(
            pitchDelay      Integer;
            ZcapGL          integernormtype;
            ZcapCL          integernormtype;
        VAR ZcapGLMax       integernormtype;
        VAR ZcapCLMax       integernormtype;
        VAR ZlagMax         Integer);
{
    Minimizes total weighted error by maximizing CL*CL / GL
    Input:
        pitchDelay      current pitch prediction lag value
                        (41 . . . maxLag)
        capGL           GL; temporary max pitch prediction
                        power
        capCL           CL; temporary max correlation
        capGLMax        GL; max pitch prediction power
        capCLMax        CL; max correlation
        lagMax          pitch delay for max correlation
    Output:
        capGLMax        GL; updated max pitch prediction power
        capCLMax        CL; updated max correlation
        lagMax          updated pitch delay for max correlation
}
VAR
    Ltemp1, Ltemp2      Integer; {32 bit}
BEGIN
    IF (ZcapCL[0] > 0) THEN
    BEGIN
        capCLSqr: = IMULR(ZcapCL[0], ZcapCL[0],
        'NCMP1');
        capCLMaxSqr: = IMULR(ZcapCLMax[0], ZcapCLMax[0],
        'NCMP2');
        Ltemp1: = ILMUL(capCLSqr, zcapGLMax[0],
        'NCMP3');
        Ltemp2: = ILMUL(capCLMaxSqr, zcapGL[0],
        'NCMP4');
        shift: = 2*ZcapCL[1]-ZcapGL[1]-2*ZcapCLMax[1] +
            ZcapGLMax[1];
        IF shift > 0 THEN
            Ltemp1: = IRSHFT(Ltemp1, shift, 'NCMP5')
        ELSE
            Ltemp2: = IRSHFT(Ltemp2, -shift, 'NCMP6');
        IF Ltemp1 > Ltemp2 THEN
        BEGIN
            ZcapGLMax[0]: = ZcapGL[0];
            ZcapCLMax[0]: = ZcapCL[0];
            ZcapGLMax[1]: = ZcapGL[1];
            ZcapCLMax[1]: = ZcapCL[1];
            ZlagMax: = pitchDelay;
        END;
    END;
END;
PROCEDURE pitchEncoding(
            ZcapGLMax       integernormtype;
            ZcapCLMax       integernormtype;
            ZlagMax         Integer;
            ZrLTPScale      Integer;
            ZpWeightScale   Integer;
        VAR ZcapGMax        integerpowertype;
        VAR ZcapCMax        integerpowertype;
        VAR ZlagX           Integer);
{
    Performs pitch delay encoding.
    Input:
    capGLMax        GL; max pitch prediction power
    capCLMax        CL; max correlation
    lagMax          pitch delay for max correlation
    rLTPScale       fixed point scale factor for pitch
                    history buffer
    pWeightScale    fixed point scale factor for input
                    speech buffer
    Output:
    capGMax         max pitch prediction power
    capCMax         max correlation
    lagX            encoded lag
```

-continued

```
}
BEGIN
    ZlagX: = ZlagMax - lagOffset;
    IF ZlagMax = lagOffset THEN
    BEGIN
        ZcapGMax[0, 0]: = 0;
        ZcapCMax[0, 0]: = 0;
        ZcapGMax[0, 1]: = 0;
        ZcapCMax[0, 1]: = 0;
    END
    ELSE
    BEGIN
        ZcapGLMax[1]: = ZcapGLMax[1] + 2*ZrLTPScale;
        ZcapCLMax[1]: = ZcapCLMax[1] + ZrLTPScale +
            ZpWeightScale;
        ZcapGMax[0, 0]: = ZcapGLMax[0];
        ZcapCMax[0, 0]: = ZcapCLMax[0];
        ZcapGMax[0, 1]: = ZcapGLMax[1];
        ZcapCMax[0, 1]: = ZcapCLMax[1];
    END;
END;
PROCEDURE pitchPrediction(
            ZlagMax         Integer;
            ZalphaWeight    integerparametertype;
            ZrLTP           integerhistorytype;
        VAR ZbLOpt          integersubframetype;
        VAR ZbPrimeLOpt     integersubframetype);
{
    Updates subframe with respect to pitch prediction.
    Input:
    lagMax          pitch delay for max correlation
    rLTP            r(n) = long term filter state, n < 0
    alphaWeight     weighted filter coefficient alpha(i)
    Output:
    bPromeLOpt      optimal filtered pitch prediction
    bLOpt           optimal pitch prediction
    Temporary:
    state           temporary state for pitch prediction
                    calculation
}
VAR
    k, m                    Integer;
    Lsignal, Ltemp, Lsave   Integer; {32 bit}
BEGIN
    IF ZlagMax = lagOffset THEN
    BEGIN
        FOR k: = 0 TO subframeLength-1 DO
            ZbLOpt[k]: = 0;
    END
    ELSE
    BEGIN
        FOR k: = 0 TO subframeLength-1 DO
            ZbLOpt[k]: = ZrLTP[k-ZlagMax];
    END;
    FOR k: = 0 TO nrCoeff DO
        state[k]: = 0;
    FOR k: = 0 TO subframeLength-1 DO
    BEGIN
        Lsignal: =ILSHFT(ZbLOpt[k], 13, 'PP1');
        FOR m: = nrCoeff DOWNTO 1 DO
        BEGIN
            Ltemp: = ILMUL(ZalphaWeight[m], state[m], 'PP2');
            Lsignal: = ILADD(Lsignal, -ILSHFT(Ltemp, 1,
        'PP30'),
            'PP3');
            state[m]: = state[m-1];
        END;
        Lsignal: = ILSHFT(Lsignal, 2, 'PP40');
        Lsave: = Lsignal;
        Lsignal: = ILADD(Lsignal, Lsave, 'PP41');
        ZbPrimeLOpt[k]: = IRSHFT(ILADD(Lsignal, 32768,
        'PP4'),
            16, 'PP5');
        state[1]: = ZbPrimeLOpt[k];
        END;
    END;
BEGIN {main}
    {
        Initialize:
            alphaWeight,
            pWeight,
```

-continued

```
        iResponse,
        rLTP
    }
    pWeightScale: = IBNORM(pWeight, pWeight, 'MAIN1');
    rLTPScale: = IBNORM(rLTP, rLTPNorm, 'MAIN2');
    pitchInit(          iResponse,      {In}
                        pWeight,        {In}
                        rLTPNorm,       {In}
                        capGLMax,       {Out}
                        capCLMax,       {Out}
                        lagMax,         {Out}
                        bPrimeL);       {Out}
FOR pitchDelay: = (subframeLength + 1) TO maxLag DO BEGIN
    normalRecursion(    pitchDelay,     {In}
                        iResponse,      {In}
                        bPrimeL,        {In/Out}
                        rLTPNorm);      {In}
    normalCalculation(  pWeight,        {In}
                        bPrimeL,        {In}
                        capGL,          {Out}
                        capCL);         {Out}
    normalComparison(   pitchDelay,     {In}
                        capGL,          {In}
                        capCL,          {In}
                        capGLMax,       {In/Out}
                        capCLMax,       {In/Out}
                        lagMax);        {In/Out}
    END; {FOR loop}
    pitchEncoding(      capGLMax,       {In}
                        capCLMax,       {In}
                        lagMax,         {In}
                        rLTPScale,      {In}
                        pWeightScale,   {In}
                        capGMax,        {Out}
                        capCMax,        {Out}
                        lagX);          {Out}
    pitchPrediction(    lagMax,         {In}
                        alphaWeight,    {In}
                        rLTP,           {In}
                        bLOpt,          {Out}
                        bPrimeLOpt);    {Out}
END.
```

I claim:

1. A method of coding a sampled speech signal vector by selecting an optimal excitation vector in an adaptive code book, said method including (a) successively reading predetermined excitation vectors from said adaptive code book, (b) convolving each read excitation vector with the impulse response of a linear filter, (c) forming for each filter output signal:

(c1) on the one hand a measure $C_I$ of the square of the cross correlation with the sampled speech signal vector;

(c2) on the other hand a measure $E_I$ of the energy of the filter output signal, (d) multiplying each measure $C_I$ by a stored measure $E_M$ corresponding to the measure $E_I$ of that excitation vector that hitherto has given the largest value of the ratio between the measure $C_I$ of the square of the cross correlation between the filter output signal and the sampled speech signal vector and the measure $E_I$ of the energy of the filter output signal, (e) multiplying each measure $E_I$ by a stored measure $C_M$ corresponding to the measure $C_I$ of that excitation vector that hitherto has given the largest value of the ratio between the measure $C_I$ of the square of the cross correlation between the filter output signal and the sampled speech signal vector and the measure $E_I$ of the energy of the filter output signal, (f) comparing the products in steps (d) and (e) to each other and substituting the stored measures $C_M$, $E_M$ by the measures $C_I$ and $E_I$, respectively, if the product in step (d) is larger than the product in step (e), and (g) choosing that excitation vector that corresponds to the largest value of the ratio between the first measure $C_I$ of the square of the cross correlation between the filter output signal and the sampled speech signal vector and the second measure $E_I$ of the energy of the filter output signal as the optimal excitation vector in the adaptive code book, wherein said method further comprises (A) block normalizing said predetermined excitation vectors of the adaptive code book with respect to the component with the maximum absolute value in a set of excitation vectors from the adaptive code book before the convolution in step (b), (B) block normalizing the sampled speech signal vector with respect to that of its components that has the maximum absolute value before forming the measure $C_I$ in step (c1), (C) dividing the measure $C_I$ from step (c1) and the stored measure $C_M$ into a respective mantissa and a respective first scaling factor with a predetermined first maximum number of levels, (D) dividing the measure $E_I$ from step (c2) and the stored measure $E_M$ into a respective mantissa and a respective second scaling factor with a predetermined second maximum number of levels, and (E) forming said products in step (d) and (e) by multiplying the respective mantissas and performing a separate scaling factor calculation.

2. The method of claim 1, wherein said set of excitation vectors in step (A) comprise all the excitation vectors in the adaptive code book.

3. The method of claim 1, wherein the set of excitation vectors in step (A) comprise only said predetermined excitation vectors from the adaptive code book.

4. The method of claim 2, wherein said predetermined excitation vectors comprise all the excitation vectors in the adaptive code book.

5. The method of claim 1, wherein the scaling factors are stored as exponents in the base 2.

6. The method of claim 5, wherein the total scaling factor for the respective product is formed by addition of corresponding exponents for the first and second scaling factor.

7. The method of claim 6, wherein an effective scaling factor is calculated by forming the difference between the exponent for the total scaling factor for the product $C_I \cdot E_M$ and the exponent for the total scaling factor of the product $E_I \cdot C_M$.

8. The method of claim 7, wherein the product of the mantissas for the measures $C_I$ and $_{EM}$, respectively, is shifted to the right the number of steps indicated by the exponent of the effective scaling factor if said exponent is greater than zero, and the product of the mantissas for the measures $E_I$ and $C_M$, respectively, is shifted to the right the number of steps indicated by the absolute value of the exponent of the effective scaling factor if said exponent is less than or equal to zero.

9. The method of claim 1, wherein the mantissas have a resolution of 16 bits.

10. The method of claim 1, wherein the first maximum number of levels is equal to the second maximum number of levels.

11. The method of claim 10, wherein the first and second maximum number of levels is 9.

12. The method of claim 1, wherein the first maximum number of levels is different from the second maximum number of levels.

13. The method of claim 12, wherein the first maximum number of levels is 9.

14. The method of claim 13, wherein the second maximum number of levels is 7.

* * * * *